United States Patent [19]

Poling

[11] 4,330,695

[45] May 18, 1982

[54] CONTROL DEVICE

[75] Inventor: Ronald W. Poling, Morrison, Ill.

[73] Assignee: General Electric Company, Fort Wayne, Ind.

[21] Appl. No.: 125,122

[22] Filed: Feb. 27, 1980

[51] Int. Cl.[3] ..... H01H 35/34

[52] U.S. Cl. ..... 200/83 P; 200/835; 200/67 R

[58] Field of Search ..... 200/83 R, 83 S, 83 SA, 200/83 P, 246, 76, 67 R, 67 D, 67 DA, 67 DB; 92/7

[56] References Cited

U.S. PATENT DOCUMENTS 3,177,313 4/1965 Klimak ..... 200/83 P 3,240,895 3/1966 Horowitz ..... 200/83 P 3,529,107 9/1970 Dobrikin ..... 200/83 P 4,091,249 5/1978 Huffman ..... 200/83 P

*Primary Examiner*—Gerald P. Tolin

*Attorney, Agent, or Firm*—Joseph E. Papin

[57] ABSTRACT

A control device has a snap-action member so as to effect the operation of a switch device from one conductive mode of a conductive mode pair to the other thereof, an actuator between the snap-action member and the switch device, and spring means engaged with the actuator for biasing it into engagement with the snap-action member.

Methods of assembly are also disclosed.

19 Claims, 7 Drawing Figures

CONTROL DEVICE

FIELD OF THE INVENTION

This invention relates generally to automotive type air conditioning systems and in particular to a control device for use therein and a method of assembling a control device.

BACKGROUND OF THE INVENTION

In the past, various different types of past or prior art control devices, such as fluid pressure actuated switches for instance, were utilized in an automotive type air conditioning system to control the energization and deenergization of a clutch actuated compressor in the system in response to a preselected low and high value of fluid pressure measured at a preselected point in the system, such as for instance in an accumulator or the like in the system. One such past control device is disclosed in the copending Ronald W. Poling application Ser. No. 960,172 filed Nov. 13, 1978, (now U.S. Pat. No. 4,200,776 issued Apr. 29, 1980) which is incorporated herein by reference.

These past control devices were provided with a housing having an opening therethrough, and a movable fluid pressure responsive member, such as a diaphragm or the like for instance, was sealably interposed across the opening in the control device housing so as to define therein a pressure fluid chamber and a switch means accommodating chamber adjacent the opposite sides of the diaphragm, respectively. A snap-action member movable between a stable configuration and an unstable configuration thereof was provided with a circumferential edge seated in the switch means accommodating chamber on the control device housing generally about the opening therein and adjacent the diaphragm, and a switching means operable generally between make and break positions for controlling a circuit through the control device was disposed in the switch means accommodating chamber generally adjacent the snap-action member. Thus, the diaphragm was movable in response to a preselected fluid pressure acting thereon in the pressure fluid chamber to effect the application of a motive or applied force onto the snap-action member thereby to cause a snap-action movement of the snap-action member from the stable configuration toward the generally inverted or unstable configuration thereof. When the snap-action member was so moved to its unstable configuration, it effected the movement of the switching means between its break position to its make position. Thereafter, in response to a reduction of the fluid pressure in the pressure fluid chamber and a corresponding reduction in the motive force acting on the snap-action member, the snap-action member returned with snap-action from its unstable configuration to its stable configuration thereby to permit return movement of the switch means from its make position to its break position. Of course, in its make and break positions, the switch means completed and interrupted the circuit through the control device which effected the energization and deenergization of the aforementioned clutch controlled or actuated compressor, respectively.

In at least some of these past control devices, an actuator was associated with a resilient current carrying arm of the switching means, and a post integral with the actuator was disposed to engage with the snap-action member substantially at a center point of a central portion thereof. Of course, when the snap-action member was actuated to its unstable configuration in response to the motive force acting thereon, as discussed above, the center point of the snap-action member engaged with the post of the actuator effected conjoint movement of the actuator with the snap-action member in order to move the arm of the switching means into the aforementioned make position thereof completing the circuit through the control device. It is believed that one of disadvantageous or undesirable features of the aforementioned at least some past control devices was that the repeated engagement or pounding of the actuator post against the highly stressed center point of the snap-action member may have added enough stress thereto to cause fracturing of the snap-action member. The repeated engagement or pounding of the actuator post against the center point of the snap-action member is believed to have been caused by undulations in the arm of the switching means which is effected by the inability of such arm to follow in engagement with the snap-action member as it translates very rapidly between the stable configuration and the unstable configuration thereof.

In others of the aforementioned past control devices, a range or coil spring had the opposite ends thereof respectively biased into engagement between a retainer therefor on the actuator and an adjusting screw threadably received in the housing of the past control devices. Of course, the range spring was utilized to adjust the forces respectively necessary to cause the snap-action movement of the snap-action member between its stable and unstable configuration. However, if the opposite end faces of the range spring and the complementary seating surfaces therefor on the actuator retainer and/or the adjusting screw were not absolutely square with each other, i.e., such opposite end faces and/or seating surfaces had tolerance variations, the range spring may have been side loaded in order to nest the opposite ends of the range spring on the seating surfaces therefor of the actuator retainer and the adjusting screw, respectively. Due to this side loading effect of the range spring, the compressive force thereof may have been so misaligned or otherwise misdirected as to cause tipping or tilting of the actuator post in its engagement with the center point of the snap-action member. It is believed that a disadvantageous or undesirable feature associated with the aforementioned tipping of the actuator post in its engagement with the snap-action member was that the effective length of the post may have been changed enough to result in the distortion of the switching means arm so as to alter the preselected switching characteristics thereof. In this vien, an analogous disadvantageous or undesirable feature is believed to be that aforementioned change in the effective length of the actuator post due to the tipping thereof may have also displaced the contact opening and closing positions of the switching means arm from those preselected therefor. In other words, with the contact opening and closing positions of the switching means arm so altered, the preselected stroke or displacement of the snap-action member upon its movement between the stable and unstable configurations thereof may not be enough to move the switching means arm into its contact closing position or, in the alternative, may have been too much so as to prevent the movement of the switching means arm to its contact opening position. This condition might, of course, have caused the switching means to either creep open or to close before the snap-action member snaps into its unstable configuration.

SUMMARY OF THE INVENTION

Among the several objects of the present invention may be noted the provision of an improved control device which at least in part overcame the above-discussed disadvantageous or undesirable features, as well as others, of the prior art control devices; the provision of such improved control device in which a snap-action member fashioned from a lighter gauge metallic material may be employed so as to reduce the noise attendant to the movement of the snap-action member between its stable and unstable configurations; the provision of such improved control device in which the force of engagement between the snap-action member and an actuator urged thereinto is predeterminately distributed in a generally circular pattern about a part of at least a generally central portion of the snap-action member so as to enhance the life expectancy of the snap-action member; the provision of such improved control device in which the actuator is resiliently urged into wheel-based engagement with the snap-action member about the part of the central portion thereof; the provision of such improved control device in which tolerance variations encountered upon the assembly of at least the snap-action member, the actuator and a range spring are resiliently absorbed by the range spring; the provision of such improved control device in which the resilient absorption of such tolerance variations by the range spring acts to automatically insure that the direction of the compressive force of the range spring is generally coincidental with a centerline axis of the control device; the provision of such improved control device in which the range of forces necessary to effect the operation of the snap-action member between its stable and unstable configurations may be more easily and more accurately attained; and the provision of such improved control device employing component parts which are simple in design, economically manufactured and easily assembled. These as well as other objects and advantageous features of the present invention will be in part apparent and in part pointed out hereinafter.

In general and in one form of the invention, a control device has means operable generally for snap-action between a stable configuration and an unstable configuration thereof including at least a generally central portion. Means for switching between a pair of conductive modes includes abutment means for wheel-based engagement with the snap-action means with the wheel-based engagement defining a generally circular pattern about a part of the central portion of the snap-action means. Resilient means is associated with the abutment means for maintaining it against displacement from its wheel-based engagement with the snap-action means.

Still in general and in one form of the invention, a control device has a housing with a centerline axis, and adjusting means having an axis generally coincidental with the housing centerline axis is adapted for adjusting movement therealong in the housing. Snap-action means is arranged for movement in the housing between a stable configuration and an unstable configuration and has a center point generally coincidental with the housing centerline axis. Means is responsive to the movement of the snap-action means for switching between a pair of conductive modes, and an actuator is associated with the snap-action means and the switching means. The actuator includes a generally annular abutment disposed in a preselected position in wheel-based engagement with the snap-action member with the wheel-based engagement defining a generally circular pattern about the center point of the snap-action means, and the actuator has an axis generally coincidental with the housing centerline axis when the abutment is in its preselected position. A coil spring has an axis generally coincidental with the housing centerline axis and includes a pair of opposite end faces seated in biased engagement against the actuator and the adjusting means so that the compressive force of the spring is directed generally along the axis thereof to maintain the abutment against displacement from its preselected position.

BRIEF DESCRIPTION OF THE DRAWINGS

Corresponding reference characters indicate corresponding parts throughout the several views of the drawings.

The exemplifications set out herein illustrate the preferred embodiment of the invention in one form thereof, and such exemplifications are not to be construed as limiting the scope of the disclosure or of the invention in any manner.

DETAILED DESCRIPTION OF THE PREFERRED EMBODIMENT

Figure 1:
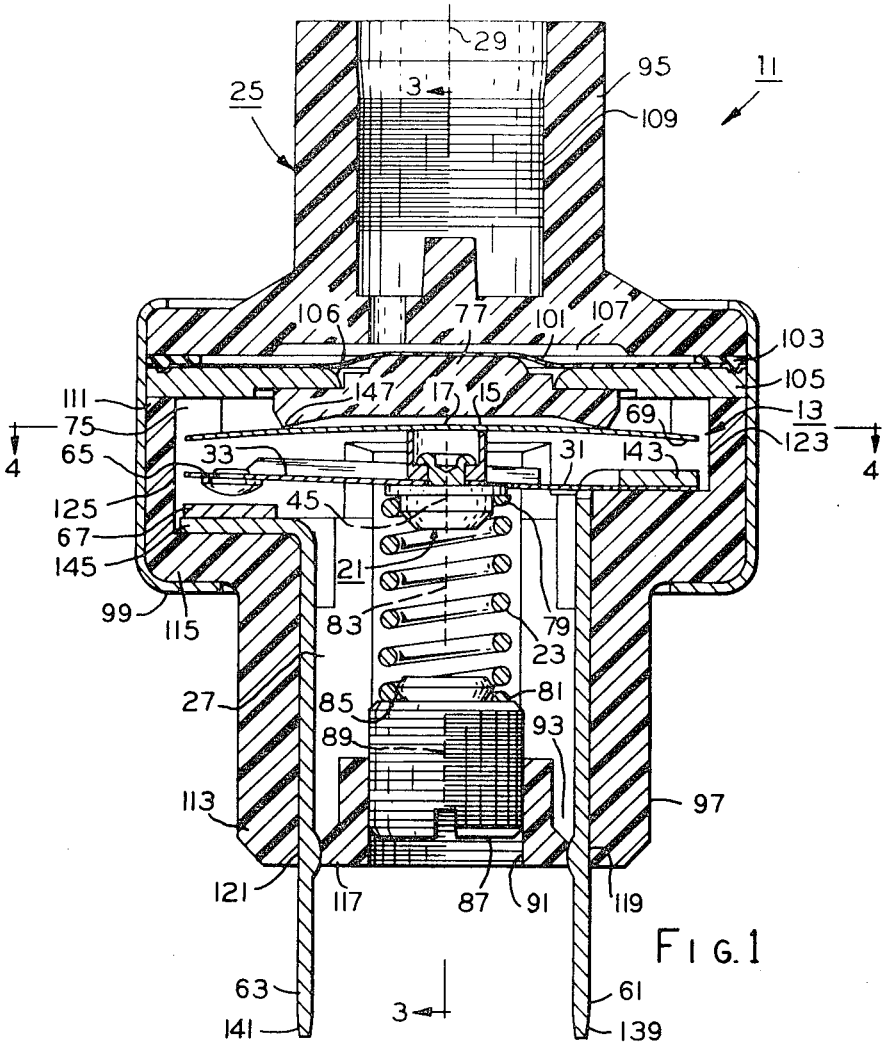
FIG. 1 is a sectional view illustrating a control device in one form of the invention and illustrating principles which may be practiced in a method of assembling the control device.
Figure 2:
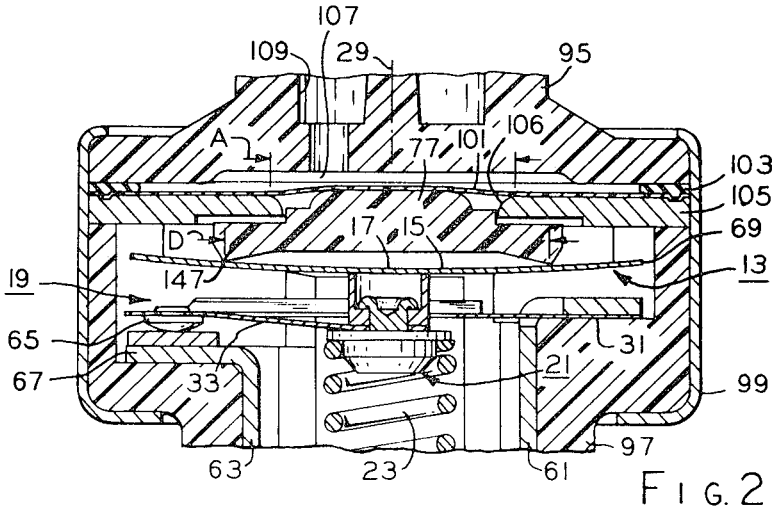
FIG. 2 is a partial sectional view taken from FIG. 1, the component parts of the control device in their actuated positions.
Figure 3:
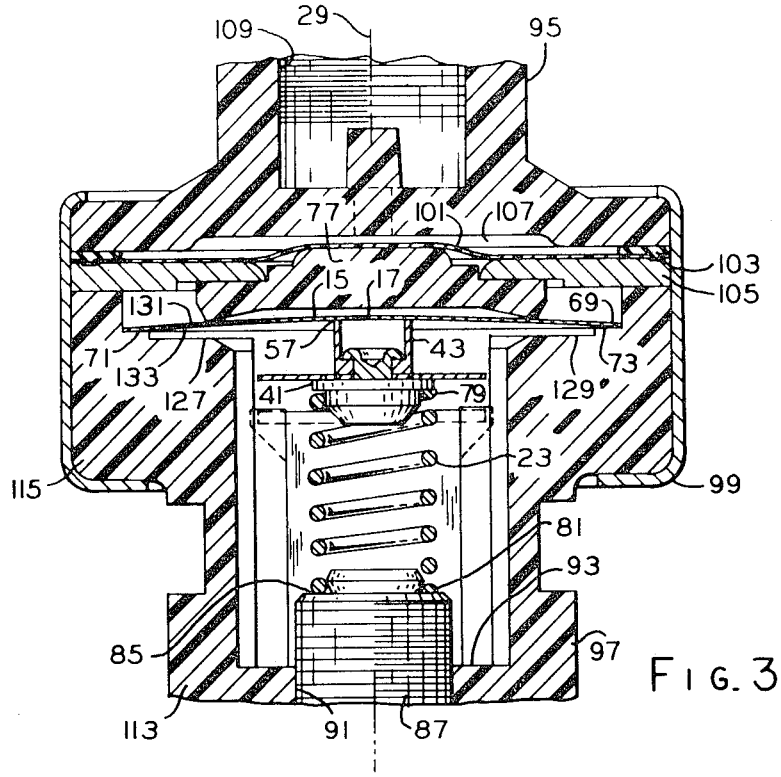
FIG. 3 is a sectional view taken along line 3—3 of FIG. 1.
Figure 4:
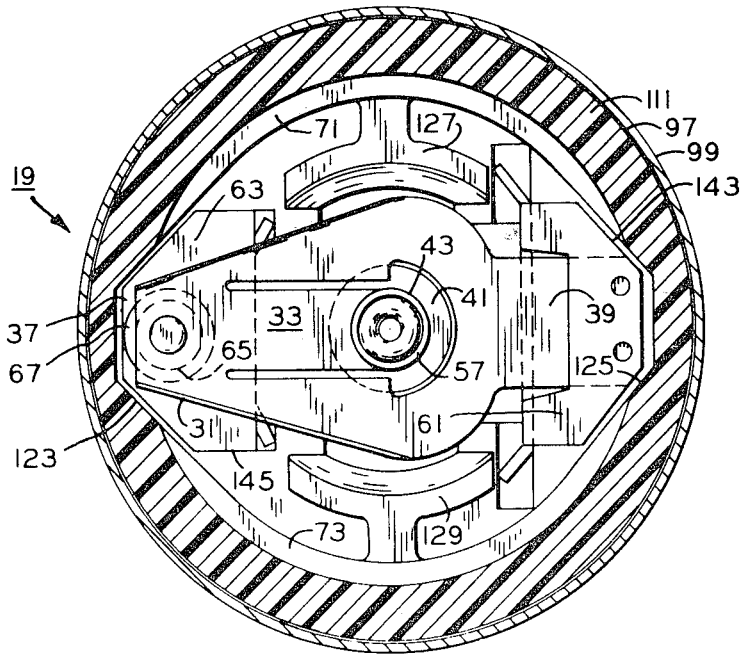
FIG. 4 is a sectional view taken along line 4—4 of FIG. 1 with a snap-action member of the control device removed to illustrate with clarity other components thereof.
Figure 5:
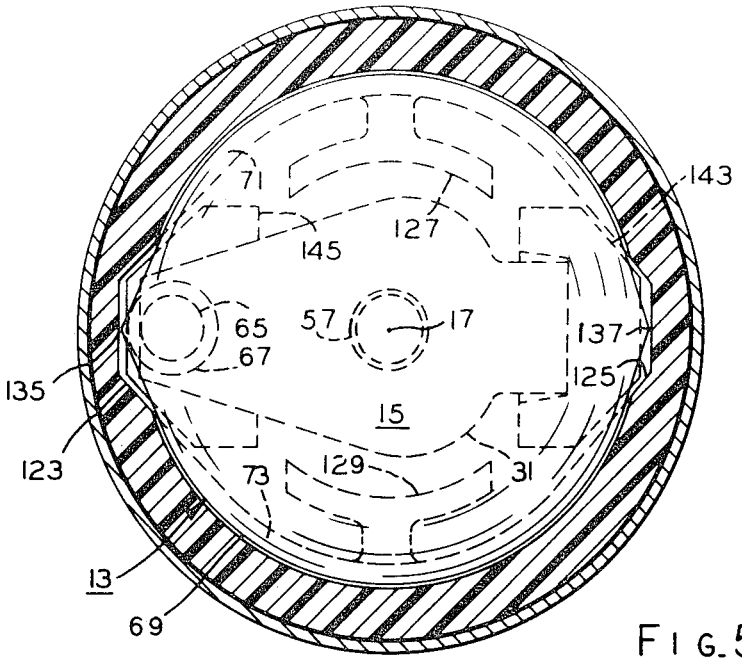
FIG. 5 is the same as FIG. 4 with the snap-action member seated in the control device.

Referring now to the drawing in general, there is illustrated a method for assembling a control device 11, such as a fluid pressure actuated electrical switch or the like for instance (FIGS. 1–6). Control device 11 has means, such as a mono-stable snap-action member 13 or the like for instance, adapted for snap-action between a stable configuration and an unstable configuration and including a central portion 15 having a center point 17 so as to effect the operation of a switching means or switch device 19 from one of a pair of conductive modes to the other thereof (FIGS. 1 and 2). A force transmitting means or member, such as an actuator means or actuator 21 or the like for instance, is provided between snap-action means or member 13 and switch device 19, and resilient or spring means, such as a coil or range spring 23 for instance, is engaged with the actuator for biasing or otherwise resiliently urging it into engagement or following engagement with the snap-action member. In this method, any tolerance variations encountered upon the engagement of spring 23 with at least actuator 21 are resiliently absorbed in the spring, and the force of the engagement between the spring and the actuator is distributed or otherwise predeterminately arranged generally in an annular or circular pattern or loci of points spaced from center point 17 of control portion 15 on snap-action member 13 (FIGS. 1–3 and 5).

More particularly and with specific reference to FIG. 1, control device 11 has a housing, indicated generally at 25, with a switch means accommodating chamber 27 therein, and it may be noted that the component parts of the control device are assembled with respect to a centerline axis 29 of the control device or housing, as discussed in greater detail hereinafter.

Switch device 19 is illustrated for purposes of disclosure as a cantilevered type having slow make and break characteristics; however, it is contemplated that other switch devices having various other configurations and different operating characteristics may be utilized within the scope of the invention so as to meet the objects thereof. Switch device 19 has a resilient current carrying switch blade or element 31 formed of any suitable material, such as beryllium copper for instance, and an actuating arm or section 33 of the switch blade has an aperture or opening 35 through the free end thereof which is integrally formed with the blade so as to extend generally within the switch blade between a pair of opposite ends 37, 39 thereof.

Actuator 21 comprises a spring guide or retainer 41 and means, such as a generally cup-shaped member 43 or the like for instance, adapted for abutment in wheel-based engagement with snap-action member 13, and the spring retainer and abutment means or cup-shaped member are assembled with switch blade 31 so as to be generally coaxial with an axis 45 of the actuator, as discussed hereinafter. Spring retainer 41 has on one side thereof means, such as an annular generally flat or squared seat or seating surface 47, for instance, for seating or retaining engagement with spring 23, and a deformable nipple or post 49 is integrally formed with the other or opposite side of the spring retainer so as to extend generally coaxially therefrom (as shown partially in dotted outline form in FIG. 6). It may be noted that seating means or spring seat 47 is machined or otherwise formed on spring retainer 41 so as to be disposed generally at a right angle or perpendicular with actuator axis 45 thereby to have a preselected tolerance variation with respect to the actuator axis. Cup-shaped member 43 has a base wall 51 with an aperture or opening 53 generally centrally provided therethrough, and the base wall is integrally formed with a generally cylindric or tubular sleeve section or portion, such as for instance annular sidewall 55, having a generally annular rim or abutment 57 defining a free end thereof. It may be noted that rim 57 of sidewall 55 may be machined, worked or otherwise formed at right angles or perpendicular with actuator axis 45 so as to have a preselected tolerance variation with respect to the actuator axis upon the assembly of actuator 21 with switch blade 31.

To effect the assembly of actuator 21 and its interconnection with actuating arm 33 of switch blade 31, nipple 49 (as shown partially in its dotted outline form in FIG. 6) of spring retainer 41 is inserted or otherwise moved through aperture 35 in the actuating arm and also through aperture 53 in base wall 51 of cup-shaped member 43 arranged or otherwise disposed on a side of the actuating arm opposite the spring retainer. With actuating arm 33 so sandwiched or otherwise engaged or arranged between spring retainer 41 and cup-shaped member 43, nipple 49 of the spring retainer is then deformed by suitable means, such as staking at 59 or the like for instance, into displacement preventing engagement with base wall 51 of the cup-shaped member. In this manner, actuator 21 is associated or otherwise assembled or mounted to switch device 19 so that spring retainer 41 and cup-shaped member 43 are generally coaxial with actuator axis 45.

Either prior or subsequent to the above-discussed assembly of actuator 21 with switch blade 31, opposite end 39 of the switch blade may be secured in electrical conductive and mechanical engagement by suitable means, such as spot welding or the like for instance, with a terminal 61. Thereafter, terminal 61 with switch blade 31 secured thereto is mounted or otherwise predeterminately located or positioned along with another terminal 63 within chamber 27 of contact device 11 so as to arrange a pair of switch contacts or contact means 65, 67 respectively carried on opposite end 37 of the switch blade and on terminal 63 in opposed relation with each other for circuit making engagement and circuit breaking disengagement.

A circumferential portion 69 of snap-action member 13 integrally formed with central portion 15 thereof is predeterminately located or otherwise arranged on means, such as a pair of split seats or seating surfaces 71, 73 for instance, for seating the snap-action member which are provided on housing 25 so as to extend at least in part generally about chamber 27 at least adjacent an upper end 75 thereof. Of course, snap-action member 13 is retained in engagement with housing split seats 71, 73 against displacement therefrom by a spacer 77 engaged with the snap-action member, as discussed in greater detail hereinafter.

Spring 23 is provided with a pair of opposite flat or squared ends or end faces 79, 81 which may be ground or otherwise formed generally at right angles or perpendicular with an axis 83 of the spring so as to have a preselected tolerance variation therewith, such as for instance generally about two degrees (2°). Either prior or subsequent to the above-discussed mounting of switch blade 31 and terminals 61, 63 in chamber 27 of control device 11, squared end face 81 of spring 23 is seated or otherwise arranged with means, such as a flat or squared generally annular seat or seating surface 85 for instance, for seating the spring end face which is provided on an adjusting screw 87, and spring seat or seating means 85 is machined or otherwise formed generally at right angles or perpendicular with an axis 89 of the adjusting screw so as to have a preselected tolerance variation therewith.

With squared end face 81 of spring 23 so seated or otherwise engaged with seat 85 of adjusting screw 87, the spring may be inserted or otherwise moved through a threaded opening 91 provided in housing 25 adjacent a lower or opposite end 93 of chamber 27 with the threaded opening being arranged generally coaxial about centerline axis 29 of control device 11. Upon the passage of spring 23 through threaded opening 91 into chamber 27, upper end face 79 of the spring is initially seated or otherwise engaged with seat 47 on spring retainer 41 of actuator 21, and adjusting screw 87 is moved into adjustable or threaded engagement with threaded opening 91. Of course, during such initial engagement of spring 23 with actuator retainer 41 and of adjusting screw 87 with threaded opening 91, the spring is only slightly compressed from the free length thereof; therefore, only a relatively light compressive force of the spring is exerted on actuator 21 so as to resiliently urge cup-shaped member 43 toward engagement with snap-action member 13.

Figure 6:
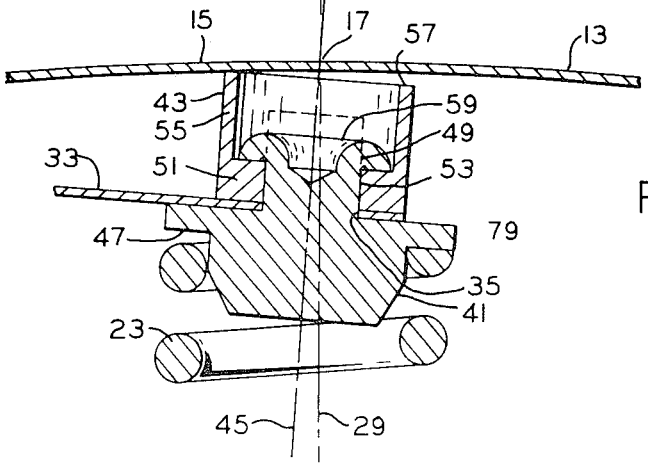
FIG. 6 is a partial sectional view illustrating an actuator of the control device as it may be initially engaged with the snap-action member during the assembly thereof.

As previously mentioned, axis 45 of actuator 21, axis 83 of spring 23, and axis 89 of adjusting screw 87 are all coincidental or otherwise aligned with centerline axis 29 of control device 11 in the preferred form of the invention. In this vein and as also previously noted hereinabove, any one or all of seat 47 and rim 57 of actuator 21, end faces 79, 81 of spring 23, and seat 85 of adjusting screw 87 may have tolerance variations, and, of course, in the worse case condition, such tolerance variations may be additive. In the event of the occurrence of the aforementioned tolerance variations when spring 23 is assembled to actuator 21 and adjusting screw 87 is received in threaded opening 91 of housing 25, the spring may be side loaded, i.e. have side-loading forces impartial thereto, during the aforementioned initial exertion of its relatively light compressive force on actuator 21. In other words, this side loading effect of spring 23 would tend to misalign or misdirect its compressive force generally angularly with respect to spring axis 83 along which it is desired to be directed as well as generally angularly with centerline axis 29 of control device 11. When spring 23 is so side loaded misdirecting its compressive force from centerline axis 29 of control device 11, such misdirected compressive force exerted on actuator 21 causes it to cant or tilt away from the centerline axis of the control device so that only a part of actuator rim 57 may be biased generally into pivotal or pivoting engagement with central portion 15 of snap-action member 13, as illustrated in FIG. 6. Of course, when actuator 21 is so canted wherein only a part of rim 57 thereof is pivotally engaged with snap-action member 13, contact 65 on switch blade 31 is displaced from the desired or preselected opening and closing position thereof with respect to contact 67 on terminal 63, and in this undesirable condition, it is believed that switch device 19 might either creep open or closed before snap-action member 13 was actuated from its stable configuration to the unstable configuration thereof, as discussed hereinafter. Furthermore, it is also believed that such misaligned compressive force acting to effect the aforementioned pivotal engagement of actuator rim 57 with snap-action member 13 may also serve to distort switch blade 31 thereby to also affect the desired or preselected open and closed position of contact 65 with respect to contact 67.

In order to obviate the above-discussed undesirable condition and effect the desired alignment of axii 45, 83 of actuator 21 and spring 23 with centerline axis 29 of control device 11, adjusting screw 87 is further adjustably or threadedly engaged with threaded opening 91 in housing 25 thereby to further compress spring 23 between actuator 21 and the adjusting screw increasing the compressive force of the spring. In response to the increased compressive force so exerted by spring onto actuator 21, the actuator is resiliently driven or otherwise pivotally urged with a wheel-basing movement generally about the part of actuator rim 57 pivotally engaged with snap-action member 13 until the actuator rim is in a preselected position thereof squarely disposed in wheel-based engagement with the snap-action member. In other words when actuator rim 57 is in its preselected position in wheel-based engagement with snap-action member 13, such engagement defines a generally circular pattern about a part of central portion 15 of the snap-action member with the circular pattern being spaced generally equidistantly from center point 17 of the snap-action member. Thus, it may be noted that when actuator rim 57 is in the wheel-based engagement thereof with snap-action member 13, the aforementioned tolerance variations, which may occur in any or all of seat 47 and rim 57 of actuator 21, ends 79, 81 of spring 23, and seat 85 of adjusting screw 87 are resiliently absorbed or otherwise compensated for by spring 23, and in response thereto, axii 45, 83 of the actuator and spring are adjustably moved or otherwise automatically aligned so as to be coincidental with centerline axis 29 of control device 11. Further, it may also be noted the wheel-based engagement between actuator rim 57 and snap-action member 13 distributes the force of such engagement in the aforementioned generally circular pattern predeterminately spaced away from center point 17 of the snap-action member which is believed to be the most highly stressed point in the snap-action member. Of course, after actuator rim 57 is so resiliently urged against displacement from its wheel-based engagement in the preselected position thereof with snap-action member 13 by the compressive force of spring 23, the compressive force may be further adjustably increased, as described above, so as to adjustably preselect or set the forces or range thereof at which the snap-action member translates between the stable configuration and unstable configuration thereof, as discussed hereinafter. While the wheel-based engagement of actuator rim 57 with snap-action member 13 is defined as a generally circular pattern, it is contemplated that the actuator rim may be interrupted as desired so that the aforementioned generally circular pattern may be similarly interrupted within the scope of the invention so as to meet the objects thereof.

Referring again in general to the drawing and recapitulating at least in part with respect to the foregoing, control device 11 in one form of the invention is provided with housing 25, and means, such as snap-action member 13, is operable generally in the housing for snap-action between the stable configuration and the unstable configuration thereof (FIGS. 1 and 2). Means, such as switch device 19, is operable for switching between a pair of conductive modes and includes abutment means, such as for instance at least actuator 21, for wheel-based engagement with snap-action means 13 with the wheel-based engagement defining a generally circular or annular pattern about central part 15 of the snap-action means. Resilient means or spring 23 is associated with abutment means or actuator 21 for maintaining it against displacement from its wheel-based engagement with snap-action means 13 (FIGS. 1–6).

More particularly and with specific reference to FIGS. 1–6, housing 25 includes a pair of upper and lower housing members or portions 95, 97 interconnected against displacement by a metallic sleeve 99 or the like, for instance. It is, of course, understood that housing portions 95, 97 may be formed of any suitable material, such as a resin, a metal or a metal alloy for instance, and that suitable means other than sleeve 49 may be employed for securing the housing members together against displacement within the scope of the invention so as to meet the objects thereof. Fluid pressure responsive means includes spacer 77 and a resilient or flexible diaphragm or diaphragm means 101 of a suitable material, and the diaphragm is sealably interposed between a sealing means, such as an O-ring seal 103 or the like for instance, and an annular metallic washer 105 or the like for instance having a central opening 106 therethrough. O-ring 103 and washer 105 are respectively abutted between opposed adjacent ends of upper and lower housing portions 95, 97. Thus, diaphragm 101 extends in sealing relation between housing portions 95, 97 and generally across upper end 75 of chamber 27 thereby to define with lower housing portion 97 the chamber. Diaphragm 101 also defines with upper housing portion 95 an expansible fluid pressure chamber 107 therein, and a threaded control port 109 adapted for connection with a source of variable control fluid pressure (not shown) is provided in the upper housing in pressure fluid communication with chamber 107 therein.

Lower housing portion 97 is provided with a plurality of walls or wall means defining with diaphragm 101 chamber 27 therein and includes at least a pair of generally cylindric stepped walls 111, 113 with an integral generally radially extending wall defining an annular shoulder 115 therebetween. The lower end of the smaller stepped wall 113 is provided with an integral transverse end or closure wall 117 having a pair of spaced apart terminal receiving slots 119, 121, and threaded opening 91 extends through the closure wall between the terminal receiving slots so as to communicate with lower end 93 of chamber 27. The upper or abutment end of larger stepped wall 111 is retained in abutment with annular washer 105 by the displacement preventing engagement of sleeve 99 with housing portions 95, 97, as previously mentioned, and seats 71, 73 are formed on the larger stepped wall between the upper end thereof and shoulder 115 so as to extend generally coaxially about centerline axis 29 of control device 11 in a plane generally vertically spaced from the upper end of the larger stepped wall. A pair of opposed notches 123, 125 are also provided in larger stepped wall 113 between the upper end thereof and shoulder 115 so as to intersect with seats 71, 73 generally between adjacent opposite ends thereof, respectively. While seats 71, 73 are disclosed herein as generally arcuate surfaces on housing portion 97, it is contemplated that other seats having different shapes, including either interrupted or uninterrupted generally circular seats, may be employed within the scope of the invention so as to meet the objects thereof. A pair of means, such as opposite abutments 127, 129 for instance, are integrally formed on shoulder 115 for supporting engagement with snap-action member 13 in its unstable configuration as best seen in FIG. 2, and the abutments or supporting means extend upwardly from the shoulder so that such abutments are disposed in a plane spaced vertically downwardly with respect to seats 71, 73 and generally radially spaced adjacent thereto within chamber 27.

Figure 7:
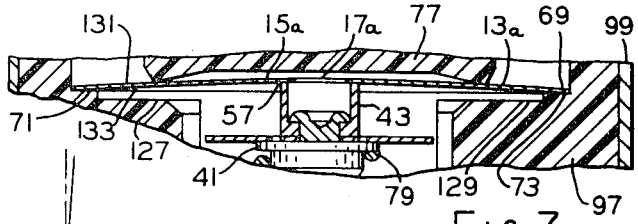
FIG. 7 is a partial sectional view illustrating the use of a Belleville spring or snap-action member in the control device of FIG. 1.

Snap-action member 13 may be formed or otherwise shaped into the stable configuration thereof, as best seen in FIG. 1, from a generally thin strip of suitable metallic material, such as a stainless steel or the like for instance, by suitable forming and shaping means well known in the art (not shown). In its stable configuration, snap-action member 13 includes generally arcuate or dome shaped central portion 15, and a pair of opposite generally arcuate or dome shaped sides or surfaces 131, 133 define the central portion and intersect with peripheral or circumferential portion or edge 69 which defines a generally constant diameter of the snap-action member generally about a major portion thereof with such diameter extending through center point 17. A pair of generally oppositely extending interlocking means, such as projections or extensions 135, 137 for instance, are integrally formed between opposite side surrfaces 131, 133 and curcumferential edge 69. While snap-action member 13 is illustrated herein for purposes of disclosure, it is contemplated that other snap-action devices, including but not limited to a circular snap-action member, an annular snap-action member or Belleville spring, and a spider or spoke type snap-action member or the like for instance, may be utilized within the scope of the invention so as to meet the objects thereof. In this vein, an annular snap-action member or Belleville spring **13*a* is shown in FIG. 7 replacing snap-action member 13 in control device 11, and it is believed that snap-action members 13 and 13*a* are functionally equivalent at least within a preselected operational limit. It may be noted that center point 17*a* of Belleville spring 13*a* is generally located within the central opening through the Belleville spring. When assembled into lower housing portion 97, at least a part of circumferential portion 69 on snap-action member 13 is predeterminately located or otherewise seated on seats 71, 73 of the lower housing portion, and the snap-action member spans generally across upper end 75 of chamber 27 so that centerline axis 29 of control device 11 extends generally through center point 17 of the snap-action member. Further, opposite projections 135, 137 of snap-action member 13 extend into opposed notches 123, 125 of lower housing portion 97 for respective abutting or locating engagement therewith. If a more detailed description of snap-action member 13, its operation and its association with lower housing portion 97** is desired, reference may be had to copending application Ser. No. 960,172 filed Nov. 13, 1978 which, as previously mentioned, is incorporated herein by reference.

Terminals or terminal means 61, 63 are fixedly arranged in lower housing portion 97 within chamber 27 thereof, and the terminals have electrical connector sections or end portions 139, 141 extending through terminal slots 119, 121 in closure wall 117 of the lower housing portion exteriorly thereof, respectively. Terminals 61, 63 also include switch means supporting sections or interior ends or flanged portions 143, 145 which overlay shoulder 115 of lower housing portion 97 within chamber 27 thereof so as to extend generally into notches 123, 125, and stationary contact 67 is carried on interior end 145 of terminal 63. Switch blade 31 has its end 39 pivotally connected to interior end 143 of terminal 61, as previously mentioned, and movable contact 65 is carried on opposite end 37 of the switch blade for circuit making engagement with an circuit breaking disengagement from contact 67. Thus, switch blade 31 and cooperating contacts 65, 67 define switching means or switch device 19 adapted for switching between a pair of circuit controlling positions or condutive modes in which the contacts are respectively made and broken.

Coil or range spring 23 is biased or interposed between retainer 21 therefore and adjusting means or adjusting screw 87 which is threadedly and adjustably received in threaded aperture 91 provided therefor in closure wall 117 of lower housing portion 97. Upon the assembly of spring 23 with actuator 21 and also of adjusting screw 87 with threaded aperture 91, as discussed in detail hereinbefore, the spring urges the actuator into wheel-based engagement with lower arcuate surface 133 of snap-action member 13 with actuator rim 57 engaging a part of central portion 15 of the snap-action member so as to define therewith the aforementioned generally circular engagement pattern generally equidistantly spaced from center point 17. Therefore, when snap-action member 13 is in its stable configuration, switch blade 31 is urged by spring 23 toward an open or circuit interrupting position disengaging or breaking contact 65 from contact 67, as best seen in FIG. 1.

Means, such as spacer 77 for instance, may be formed of any suitable material, such as a resin for instance, and is operable for transmitting force onto snap-action member 13, as discussed hereinafter. Force transmitting means or spacer 77 is reciprocally movable and guidably mounted within opening 106 in annular washer 105 in abutting or force transmitting engagement between snap-action member 13 and diaphragm 101. A generally circular or annular ridge or abutment 147 on the lower side of spacer 77 is arranged generally coaxially with centerline axis 29 of control device 11 and in force transmitting engagement with snap-action member 13, and the ridge is defined by a generally constant diameter D. The other side of spacer 77 opposite ridge 147 thereof is arranged in abutment or force transmitting engagement with diaphragm 101 which has an effective area A defined generally by the flexing engagement of the diaphragm about opening 106 in annular washer 105. Thus, area A and diameter D of ridge 147 are opposite each other, and diameter D is predeterminately larger than another diameter of area A. In this manner, the control force established by a control fluid pressure in chamber 107 acting on effective area A is distributed by ridge 147 of spacer 77 onto central portion 15 of snap-action member 13 in a generally circular or annular pattern spaced more closely to circumferential portion 69 thereof. As is well known to the art, when the actuating force is applied in a generally circular pattern farther away from the center point of a snap-action member, the resistance of such snap-action member to actuation from the stable configuration to the unstable configuration thereof in response to such force is increased. In view of the foregoing, the magnitude of the control force acting on spacer 77 may be regulated or reduced by predeterminately sizing the diameter of area A with respect to diameter D, and the resistance of snap-action member 13 to actuation in response to the control force is increased as such force is exerted thereon through spacer ridge 147 at a distance farther from center point 17 of the snap-action member toward circumferential portion 79 thereof. Therefore, due to the predetermined differential between the diameter of area A and diameter D, it is believed that a lighter snap-action member 13, i.e. formed of a more thin or lighter gauge metal, having a lesser resistance to actuation or operation from the stable configuration to the unstable configuration thereof may be employed in control device 11. It is also believed that a lighter gauge snap-action member 13 will be less audible, i.e. have less of a clicking or cricket sound, when actuated between its stable and unstable configurations. Further, since annular snap-action member **13*a* is believed to be functionally equivalent within operational limits to full dome type snap-action member 13, as discussed hereinbefore, it is believed that diaphragm 101 and spacer 77** could be employed in combination with such an annular snap-action member to effect its snap-action operation generally in the same manner discussed hereinabove within the scope of the invention so as to meet the objects thereof.

With respect to the operation of control device 11, assume that the compressive force of range spring 23 has been adjustably set by operator actuation of adjusting screw 87 to a preselected value which not only urges rim 57 of actuator 21 into its preselected or predetermined position in wheel-based engagement about center point 17 of snap-action member 13 but also predetermines the respective values of the forces necessary to effect the operation of the snap-action member between the stable and unstable configurations thereof, as discussed in detail hereinbefore. Thus, with the component parts of control device 11 disposed in their respective assembled positions, as illustrated in FIG. 1 for instance, further assume that control fluid pressure established at port 109 and in control chamber 107 is selectively increased to a preselected "on" value great enough to effect actuation of control device 11. This preselected fluid pressure in chamber 107 acts on effective area A of diaphragm 101 to establish the applied actuating or control force which is transferred through spacer 77 onto central portion 17 of snap-action member 13 by the engagement therewith of spacer ridge 147 when the snap-action member is in its stable configuration, as best seen in FIG. 1. The control force so exerted on snap-action member 13 effects the actuation or operation of the snap-action member from its stable configuration with characteristic snap-action movement toward the unstable configuration thereof, i.e. the snap-action member assumes a generally inverted position, as best seen in FIG. 2. Since rim 57 of actuator 21 is biased or otherwise resiliently urged into its preselected position in wheel-based engagement about a part of central portion 15 on snap-action member 13 in spaced relation with center point 17 thereof so as to be generally coaxial with centerline axis 29 of control device 11, as previously discussed, the snap-action movement of the snap-action member to its unstable configuration or inverted position moves or otherwise conjointly drives the actuator downwardly against the compressive force of range spring 23. Of course, upon the adjusting setting of the compressive force of range spring 23, such compressive force is predeterminately aligned or otherwise coincidentally directed along centerline axis 29 of control device 11, as previously discussed, and acts on retainer 21 so as to oppose the movement of snap-action member 13 toward its unstable configuration. Thus, the conjoint movement of actuator 21 with snap-action member 13 toward its unstable configuration effects generally conjoint pivotal movement therewith of switch blade 31 generally about interior end 143 of terminal 61 from its open position, i.e. a conductive mode of switch device 19 in which it is non-conductive, so as to move switch contact 65 into making engagement with contact 67 on interior end 145 of terminal 63 thereby to complete a circuit through control device 11 wherein switch device 19 is placed in its conductive mode. Since actuator 21 is biased into its preselected position in wheel-based engagement with snap-action member 13, as previously described, it may be noted that the open and closed positions of switch contact 65 with respect to its cooperating contact 67 are predeterminately maintained within the useful stroke or movement of snap-action member 13 from the stable configuration to the unstable configuration thereof thereby to obviate the possibility of switch device 19 to either creep open or creep closed before the snap-action member becomes unstable and snaps toward its unstable configuration.

When the control fluid pressure in control chamber 107 is reduced to another preselected or "off" value which is predeterminately less than the aforementioned preselected "on" value thereof, the control force transmitted through spacer 77 onto snap-action member 13 is, of course, correspondingly reduced, and in response to such reduced control force, the snap-action member operates so as to revert or return with snap-action movement from the unstable configuration to the stable configuration thereof. This return movement of snap-action member 13 is, of course, assisted by the compressive force of range spring 23 which urges or moves actuator 21 toward following wheel-based engagement with the snap-action member. Upon this reversion of snap-action member 13 to its stable configuration, the following movement therewith of retainer 21 in response to the compressive force of range spring 23 is effective to pivotally return switch blade 31 toward its open position breaking contact 65 thereof from contact 67. In this manner, the breaking of contacts 65, 67 effects the interruption of the circuit through control device 11 between terminals 61, 63 thereof.

In view of the foregoing, it is now apparent that a novel control device 11 is presented meeting the objects and advantages therefore as discussed hereinabove, as well as others, and that changes in the precise configurations, arrangements, details and connections of the component parts, illustrated herein by way of example for purposes of disclosure, may be made by those having ordinary skill in the art without departing from the spirit of the invention or the scope of the invention as set out in the claims which follow.

What I claim as new and desire to secure by Letters Patent of the United States is:

1. A control device comprising:

a pair of housing members secured together against displacement;

a diaphragm interposed between said housing members and defining with said housing members a pair of chambers therein;

a control port in one of said housing members adapted for subjection to fluid pressure and communicated with one of said chambers;

a snap-action member operable between a stable configuration and an unstable configuration and including a circumferential portion seated at least in part on the other of said housing members within the other of said chambers, a central portion integral with said circumferential portion and spanning at least in part across said other chamber, and a center point of said snap-action member within said central portion;

a spacer arranged in abutment between said diaphragm and said snap-action member and operable generally for effecting the operation of said snap-action member toward its unstable configuration when the control fluid pressure at said control port and acting on said diaphragm attains a preselected value;

a pair of terminal means mounted in said other housing member and extending in part exteriorly of said other housing member;

a resilient switch blade connected with one of said terminal means within said other chamber;

a pair of contact means on said switch blade and the other of said terminal means adapted for making engagement with each other and breaking disengagement from each other, respectively, actuator means interposed between said snap-action member and said switch blade for driving it toward a position in which one of said contact means is disposed in the making engagement with other of said contact means upon the operation of said snap-action member toward its unstable configuration, said actuator means including a generally cup-shaped member having a generally annular rim arranged in wheel-based engagement with said snap-action member so as to extend generally about a part of said central portion of said snap-action member in radial spaced relation with said center point;

a coil spring having one of a pair of opposite ends thereof biased into engagement with said actuator means and with the compressive force of said coil spring acting to maintain said annular rim of said cup-shaped member against displacement from its wheel-based engagement with said snap-action member; and an adjusting screw threadedly engaged with said other housing member and disposed in abutment with the other opposite end of said coil spring, said adjusting screw being threadedly movable in said other housing member to adjust the compressive force of said coil spring acting to maintain said annular rim of said cup-shaped member against the displacement from its wheel-based engagement with said snap-action member.

2. A control device comprising:

a housing;

means in said housing operable generally for snap-action between a stable configuration and an unstable configuration and including at least a central portion;

means in said housing for switching between a pair of conductive modes and including a generally tubular sleeve section having a generally annular rim thereon disposed in wheel-based engagement with said snap-action means and with the wheel-based engagement defining a generally circular pattern about at least a part of said at least central portion of said snap-action means; and resilient means for urging said rim thereof against displacement for its wheel-based engagement with said snap-action means.

3. A control device as set forth in claim 2 wherein said snap-action means further includes a circumferential portion seated at least in part on said housing and integral with said at least central portion, said rim of said abutment means being disposed in its wheel-based engagement with said snap-action means generally between said circumferential portion and said at least central portion so as to extend generally about said at least part thereof.

4. A control device as set forth in claim 2 wherein said snap-action means comprises an uninterrupted snap disc.

5. A control device as set forth in claim 2 wherein said snap-action means comprises an annular snap disc having an opening through said at least central portion, said rim of said tubular sleeve section being disposed in its wheel-based engagement with said snap-action means at least adjacent said opening.

6. A control device as set forth in claim 2 further comprising means associated with said resilient means for adjusting the force thereof exerted against said abutment means.

7. A control device as set forth in claim 2 further comprising a control port in said housing and adapted to be subjected to a control fluid pressure, and force transmitting means operable generally in response to a preselected value of the control fluid pressure at said control port for effecting the operation of said snap-action means toward its unstable configuration.

8. A control device as set forth in claim 7 wherein said force transmitting means includes a spacer having a pair of opposite sides, a generally circular ridge on one of said opposite sides having a predetermined diameter and engaged with said snap-action means so as to extend generally about at least another part of said at least central portion thereof, and diaphragm means arranged in said housing for driving engagement with the other of said opposite sides of said spacer and having an effective area defined by another predetermined diameter adapted to be subjected to the control fluid pressure at said control port, said another predetermined diameter of said diaphragm being less than said first named predetermined diameter on said spacer.

9. A control device as set forth in claim 2 comprising a generally cup-shaped member associated with said switching means and including said tubular sleeve section and said rim, and means fixedly connected with said cup-shaped member for retaining engagement with said resilient means, and said switching means having a section thereof retained in engagement between said cup-shaped member and said retaining means.

10. A control device comprising:

a housing having a centerline axis;

means in said housing operable generally for snap-action between a stable configuration and an unstable configuration thereof and having a center point arranged generally coincidentally with the centerline axis of said housing;

means operable generally for switching between a pair of conductive modes;

actuator means arranged at least in part between said snap-action means and said switching means for effecting the operation thereof in response to the operation of said snap-action means between the stable configuration and the unstable configuration thereof, said actuator means having a generally tubular sleeve portion with an annular rim thereon arranged to engage in a preselected position with said snap-action means so as to be generally radially spaced about the center point thereof;

resilient means for directing its compressive force generally along an axis thereof arranged generally coincidentally with the centerline axis of said housing so as to urge said rim of said actuator means against displacement from its preselected position in engagement with said snap-action member; and means movable in said housing and engaged with said resilient means for adjusting the compressive force thereof.

11. A control device comprising:

a housing having a centerline axis;

adjusting means having an axis generally coincidental with said housing centerline axis and adapted for adjusting movement therealong in said housing;

snap-action means arranged for movement in said housing between a stable configuration and an unstable configuration and having a center point generally coincidental with said housing centerline axis;

means responsive to the movement of said snap-action means for switching between a pair of conductive modes;

an actuator associated with said snap-action means and said switching means and including a generally tubular sleeve portion with a free end defined by an annular rim disposed in a preselected position in wheel-based engagement with said snap-action member and with the wheel-based engagement defining a generally circular pattern about the center point of said snap-action member, and said actuator having an axis generally coincidental with said housing centerline axis when said rim is in its preselected position;

a coil spring having an axis generally coincidental with said housing centerline axis and including a pair of opposite end faces seated in biased engagement against said actuator and said adjusting means so that the compressive force of said spring is directed generally along the axis thereof to urge said rim against displacement from its preselected position.

12. A control device as set forth in claim 11 wherein the resiliency of the spring automatically compensates for any tolerance variations in the event of the occurrence thereof between the respective seated engagements of said opposite end faces of said spring with said actuator and said adjusting means and between the wheel-based engagement of said rim with said snap-action means so as to maintain the compressive force of said spring directed generally along the axis thereof and to urge said rim against displacement from its preselected position.

13. A control device as set forth in claim 11 further comprising fluid pressure responsive means in said housing for effecting the movement of said snap-action means between the stable configuration and the unstable configuration thereof.

14. A control device as set forth in claim 13 wherein said fluid pressure responsive means includes a diaphragm means adapted for subjection to a fluid pressure, and a spacer arranged in abutment between said diaphragm means and said snap-action means.

15. A control device as set forth in claim 14 wherein said fluid pressure responsive means further includes a first effective area on said diaphragm means responsive to the fluid pressure when subjected thereto, and generally annular means on said spacer for engagement with said snap-action means and with said generally annular means having a diameter on said spacer greater than another diameter of said first effective area and in opposite facing relation therewith.

16. A control device as set forth in claim 11 wherein said spring automatically compensates for any side loading thereof so as to maintain the direction of the compressive force of said spring generally coincidental with said housing centerline axis and to maintain said abutment against displacement from its preselected position.

17. A control device as set forth in claim 11 wherein said actuator and adjusting means include a pair of seats arranged generally perpendicular to the axii thereof and engaged with said opposite end faces of said spring, respectively, said opposite end faces of said spring being arranged generally perpendicular to the axis thereof, and said abutment of said actuator being arranged generally perpendicular to the axis thereof.

18. A control device comprising:

a housing;

means in said housing operable generally for snap-action between a stable configuration and an unstable configuration and including at least a central portion;

a control port in said housing and adapted for subjection to a control fluid pressure;

force transmitting means in said housing and operable generally in response to a preselected value of the control fluid pressure at said control port for effecting the operation of said snap-action means toward its unstable configuration, said force transmitting means including a spacer having a pair of opposite sides, a generally circular ridge on one of said opposite sides having a predetermined diameter and engaged with said snap-action means so as to extend generally about another part of said central portion thereof, and diaphragm means arranged in said housing for driving engagement with the other of said opposite sides of said spacer and having an effective area adapted for subjection to the control fluid pressure at said control port, the effective area of said diaphragm means exposed to the control fluid pressure being defined by another predetermined diameter less than the first named predetermined diameter of said spacer;

means in said housing for switching between a pair of conductor modes and including sleeve means for abutment in wheel-based engagement with said snap-action member and with the wheel-based engagement defining a generally circular pattern about a part of said at least central portion of said snap-action means; and resilient means for urging said abutment means against displacement from its wheel-based engagement with said snap-action means.

19. A control device comprising:

a housing;

means in said housing operable generally for snap-action between a stable configuration and an unstable configuration and icluding at least a central portion;

means in said housing for switching between a pair of conductive modes and including means for abutment in wheel-based engagement with said snap-action means with the wheel-based engagement defining a generally circular pattern about a part of said at least central portion of said snap-action means;

resilient means for urging said abutment means against displacement from its wheel-based engagement with said snap-action means; and said abutment means including a generally cup-shaped member having a generally annular rim disposed in the wheel-based engagement generally about said part of said at least central portion of said snap-action means, and means fixedly connected with said cup-shaped member for retaining engagement with said resilient means, said switching means having a section thereof retained in engagement between said cup-shaped member and said retaining means.

* * * * *